US010149517B2

(12) United States Patent
McKean

(10) Patent No.: US 10,149,517 B2
(45) Date of Patent: Dec. 11, 2018

(54) CONNECTOR MECHANISM FOR ATTACHING ACCESSORY AND ACCESSORY THEREFOR

(71) Applicant: Dawn McKean, New Oxford, PA (US)

(72) Inventor: Dawn McKean, New Oxford, PA (US)

(73) Assignee: Minkaa Daisy Lockets & More, LLC, New Oxford, PA (US)

( * ) Notice: Subject to any disclaimer, the term of this patent is extended or adjusted under 35 U.S.C. 154(b) by 353 days.

(21) Appl. No.: 15/132,933

(22) Filed: Apr. 19, 2016

(65) Prior Publication Data

US 2016/0374418 A1 Dec. 29, 2016

Related U.S. Application Data

(60) Provisional application No. 62/183,242, filed on Jun. 23, 2015.

(51) Int. Cl.

| | |
|---|---|
| ***A44C 1/00*** | (2006.01) |
| *A44C 25/00* | (2006.01) |
| *A44B 1/28* | (2006.01) |

(52) U.S. Cl.

CPC ..... *A44C 1/00* (2013.01); *A44B 1/28* (2013.01); *A44C 25/002* (2013.01); *A44D 2203/00* (2013.01)

(58) Field of Classification Search

CPC . A44C 25/002; A44C 25/004; A44C 17/0208; A44B 1/18; A44B 1/34; A44B 1/28; A44D 2203/00; Y10T 24/32; A45C 13/1069; A47G 2001/0672

USPC ..... 24/3.1, 3.7, 13, 303, 3.12, 72.7; 63/18, 63/900; 40/1.6, 5, 651, 661.01, 600, 711; 248/206.5, 309.4

See application file for complete search history.

(56) References Cited

U.S. PATENT DOCUMENTS

| | | | |
|---|---|---|---|
| 259,247 | A | 6/1882 | Uebele |
| 368,984 | A | 8/1887 | Vollmee |
| 1,028,217 | A | 6/1912 | Archile |
| 1,045,106 | A | 11/1912 | Mayer |
| 2,897,511 | A | 2/1958 | Blair |
| 3,402,808 | A | 9/1968 | Yannuzzi |

(Continued)

FOREIGN PATENT DOCUMENTS

| | | |
|---|---|---|
| CA | 823395 | 9/1969 |
| CN | 203469237 U | 3/2014 |

(Continued)

*Primary Examiner* — Jack W Lavinder

(74) *Attorney, Agent, or Firm* — William C. Schrot; AuerbachSchrot LLC

(57) ABSTRACT

A connector mechanism for releasably securing an accessory to an article of apparel includes an accessory and a cooperating backer. The accessory has first and second opposing sides and a cavity extending into the second side. The backer includes a protrusion extending outwardly from a central portion thereof and receivable in the cavity, and a sidewall portion extending outwardly from the peripheral portion. The sidewall portion comprises a plurality of spaced limbs disposed around the protrusion, which are flexibly tensionable against the article. A magnet is coupled to the accessory or the backer, wherein the magnet is adjacent to the protrusion when the protrusion is received in the cavity, the accessory being magnetically coupleable to the backer via the magnet.

19 Claims, 14 Drawing Sheets

(56) References Cited

U.S. PATENT DOCUMENTS

| | | | | |
|---|---|---|---|---|
| 3,686,894 | A | 8/1972 | Elliot | |
| 4,912,608 | A | 3/1990 | Lee | |
| 5,586,452 | A | 12/1996 | Schmid | |
| 6,170,088 | B1 | 1/2001 | Tate | |
| 6,282,760 | B1 | 9/2001 | Mars | |
| 6,718,797 | B2 | 4/2004 | Plumly | |
| 6,820,282 | B1 | 11/2004 | England et al. | |
| 7,120,972 | B2 | 10/2006 | O'Banion | |
| 7,406,792 | B2 * | 8/2008 | Chang | A47G 1/0605 40/711 |
| 8,596,090 | B1 | 12/2013 | Smith | |
| 8,615,853 | B2 | 12/2013 | Rathbun | |
| 8,820,117 | B2 | 9/2014 | Fox | |
| 2007/0151084 | A1 | 7/2007 | Long | |
| 2007/0295028 | A1 | 12/2007 | Talmor | |
| 2010/0048329 | A1 | 2/2010 | Shwartz et al. | |
| 2010/0050689 | A1 | 3/2010 | Hurwitz | |
| 2012/0005809 | A1 | 1/2012 | Johnson | |
| 2012/0125046 | A1 | 5/2012 | Vander Wal et al. | |
| 2012/0216374 | A1 | 8/2012 | Manuello | |
| 2013/0216085 | A1 | 8/2013 | Honeycutt | |

FOREIGN PATENT DOCUMENTS

| | | | | |
|---|---|---|---|---|
| EP | 0170852 | A1 * | 2/1986 | A41F 1/002 |
| WO | WO 9842225 | | 10/1998 | |
| WO | WO 03015561 | | 2/2003 | |

* cited by examiner

CONNECTOR MECHANISM FOR ATTACHING ACCESSORY AND ACCESSORY THEREFOR

CROSS-REFERENCE TO RELATED APPLICATIONS

This application is based on U.S. Provisional Patent Application Ser. No. 62/183,242, entitled "Locket and Method of Securing a Locket," filed Jun. 23, 2015, which application is incorporated herein by reference in its entirety and to which priority is claimed.

FIELD OF THE INVENTION

The present invention relates to an accessory attachment system including a decorative accessory, and a connector mechanism for releasably securing the accessory to a flexible sheet of material, such as an article of apparel, so that the accessory is securely held in a desired location and orientation on the material.

BACKGROUND OF THE INVENTION

There are many different styles of accessories worn for individual adornment, such as lockets, brooches, necklaces, pins, and other such jewelry items. Other accessories may be worn to identify characteristics, status, preferences, etc. of a wearer, such as nametags, badges, or other such identifying items. Such accessories may be worn at particular locations on the wearer and/or on the wearer's apparel. In addition, such accessories are typically configured to be worn in a particular orientation relative to the wearer and/or the wearer's apparel.

However, most conventional accessories are not adaptable to be worn at different locations on the wearer. As such, in order to display accessories at different locations, an individual must often purchase many different types of accessories. However, purchasing many different accessories is relatively expensive, and does not permit an individual to display a single accessory item in multiple locations.

In addition, many conventional accessories include an attachment mechanism that is not suitable for all types of apparel and/or fails to retain the accessory in the proper location and orientation on the wearer. For example, some conventional accessories are secured to the wearer's apparel via a pin, which tends to damage delicate apparel materials or fails to retain the accessory in its proper position. Other conventional accessories are secured via a spring clip or other such clamp (e.g., such as name tags), which tend to rotate or become misaligned on the apparel and may also damage the material. Moreover, many conventional attachment mechanisms are not suitable for use with thicker or heavier materials (e.g., such as felt, wool, denim, etc.), and fail to adequately secure the accessory to such materials.

The present invention relates to an accessory system including a connector mechanism and cooperating accessory that overcomes some or all of the above-noted problems. The present invention also relates to a unique accessory suitable for use with the connector mechanism of the present invention and releasably securable to a wearer's apparel.

SUMMARY OF THE INVENTION

The present invention is directed an accessory attachment system including an accessory configured to be secured to a flexible sheet of material (e.g., apparel), and a connector mechanism for securing the accessory to the material. The connector mechanism permits releasable attachment of the accessory to the wearer, securely retaining the accessory in a selected location and orientation.

In one embodiment, the accessory is configured as a locket including a body portion, an attachment portion having an inner face and an outer face, the inner face arranged and disposed to detachably secure the body portion thereto, and a backing portion, the backing portion arranged and disposed to detachably secure the attachment portion thereto. The body portion is arranged and disposed to receive and selectively display an object therein.

In another embodiment, a locket includes a body portion, an attachment portion, an intermediate portion including a coupling member extending therefrom, and a backing portion. The body portion includes an outer surface, the outer surface having a recessed section formed therein. The attachment portion includes an inner face having a raised section extending therefrom, the raised section including a magnetic material, an outer face having an elongated member extending therefrom, and an opening formed in a perimeter thereof. The backing portion is arranged and disposed to engage the elongated member and detachably secure the attachment portion thereto. The recessed section of the body portion is arranged and disposed to magnetically engage the raised section of the attachment portion, aligning the body portion with the attachment portion and detachably securing the body portion to the attachment portion. The attachment portion is arranged and disposed to detachably secure the intermediate portion between the inner face thereof and the outer surface of the body portion, the coupling member extending through the opening in the attachment portion when detachably secured thereto. The body portion is arranged and disposed to receive and selectively display an object therein.

The present invention also provides for a method of securing a locket to an article, including positioning an outer face of an attachment portion of the locket adjacent to an outer surface of the article, positioning a backing portion of the locket opposite the outer face of the attachment portion and adjacent to an inner surface of the article, engaging the attachment portion through the article with the backing portion, the engaging of the attachment portion with the backing portion detachably securing the attachment portion to the article and the backing portion, and magnetically engaging an outer surface of a body portion with a raised section on an inner face of the attachment portion, the magnetic engaging of the body portion with the attachment portion detachably securing the body portion to the attachment portion. The body portion is arranged and disposed to receive and selectively display an object therein.

In accordance with some embodiments, a locket comprises a body portion, an attachment portion having an inner face and an outer face, the inner face arranged and disposed to detachably secure the body portion thereto, and a backing portion, the backing portion arranged and disposed to detachably secure the attachment portion thereto. The body portion is arranged and disposed to receive and selectively display an object therein.

In some embodiments, the locket comprises an article positioned between the attachment portion and the backing portion, the backing portion detachably securing the attachment portion to the article.

In some embodiments, the locket further comprises an intermediate portion positioned between the body portion and the attachment portion, the intermediate portion detachably secured to the attachment portion.

In some embodiments, the locket further comprises a coupling member extending from the intermediate portion, and an opening formed in a perimeter of the attachment portion. The coupling member extends through the opening when the intermediate portion is secured to the attachment portion.

In some implementations, the attachment portion of the locket further comprises a raised section on the inner face, the raised section including a magnetic material. In some implementations, the body portion of the locket magnetically engages the magnetic material, thereby detachably securing the body portion to the attachment portion.

In some embodiments, the locket further comprises a recessed section formed in an outer surface of the body portion, the recessed section arranged and disposed to mechanically engage the raised section of the attachment portion and align the body portion with the attachment portion.

In some embodiments, the attachment portion further comprises an elongated member extending from the outer face. In some implementations, the backing portion engages the elongated member through the article, securing the attachment portion to the article.

In some embodiments, the body portion comprises a first member and a second member, the first member movably coupled to the second member. In some implementations, the first member and the second member include an open position in which the object in the body portion is visible, and a closed position in which the object in the body portion is not visible.

In some embodiments, the body portion comprises a display area, a cover member movably positioned over the display area, and an actuating member coupled to the cover member. In some implementations, the actuating member is configured to move the cover member between an open position in which the object in the body portion is visible through the display area, and a closed position in which the object is not visible through the display area.

In some embodiments, the locket includes a disc member having a plurality of raised portions. In some implementations, the plurality of raised portions consists of three raised portions, each of the raised portions being arranged and disposed to detachably secure an accessory thereto.

In accordance with some embodiments, a locket is provided comprising: a body portion including an outer surface, the outer surface having a recessed section formed therein; an attachment portion including: an inner face having a raised section extending therefrom, the raised section including a magnetic material; an outer face having an elongated member extending therefrom; and an opening formed in a perimeter thereof; an intermediate portion including a coupling member extending therefrom; and a backing portion arranged and disposed to engage the elongated member and detachably secure the attachment portion thereto; wherein the recessed section of the body portion is arranged and disposed to magnetically engage the raised section of the attachment portion, aligning the body portion with the attachment portion and detachably securing the body portion to the attachment portion; wherein the attachment portion is arranged and disposed to detachably secure the intermediate portion between the inner face thereof and the outer surface of the body portion, the coupling member extending through the opening in the attachment portion when detachably secured thereto; and wherein the body portion is arranged and disposed to receive and selectively display an object therein.

The present invention also provides for a method of securing a locket to an article, the method comprising: positioning an outer face of an attachment portion of the locket adjacent to an outer surface of the article; positioning a backing portion of the locket opposite the outer face of the attachment portion and adjacent to an inner surface of the article; engaging the attachment portion through the article with the backing portion, the engaging of the attachment portion with the backing portion detachably securing the attachment portion to the article and the backing portion; and magnetically engaging an outer surface of a body portion with a raised section on an inner face of the attachment portion, the magnetic engaging of the body portion with the attachment portion detachably securing the body portion to the attachment portion; wherein the body portion is arranged and disposed to receive and selectively display an object therein. In some implementations, the method further provides the steps of: detachably securing an intermediate portion to the inner face of the attachment portion; and then magnetically engaging the outer surface of the body portion with the raised section on the inner face of the attachment portion; wherein the intermediate portion is positioned between the inner face of the attachment portion and the outer surface of the body portion.

The present invention also relates to a connector mechanism for releasably securing an accessory to an article of apparel. The mechanism includes an accessory comprising a first side and an opposite second side, and a cavity extending into the second side. A backer comprises a central portion and a peripheral portion. A protrusion extends outwardly from the central portion and is receivable in the cavity. A sidewall portion extends outwardly from the peripheral portion. The sidewall portion comprises a plurality of spaced limbs disposed around the protrusion. A magnet is coupled to one of the accessory or the backer. The magnet is adjacent to the protrusion when the protrusion is received in the cavity, so that the accessory is magnetically coupleable to the backer via the magnet.

In one embodiment, the magnet encircles the protrusion when the protrusion is received in the cavity. In one embodiment, the magnet is coupled to the accessory and disposed adjacent to the cavity. The magnet may be a first magnet, wherein the mechanism includes a second magnet coupled to the backer and coupleable to the first magnet when the protrusion is received in the cavity.

In one embodiment, the backer comprises a portion formed from or comprising a magnetic material (e.g., such as a metal), which is coupleable to the magnet when the protrusion is received in the cavity.

In one embodiment, the magnet is coupled to the backer adjacent to the protrusion. The magnet may be a first magnet, wherein the mechanism includes a second magnet coupled to the accessory and coupleable to the first magnet when the protrusion is received in the cavity.

In one embodiment, the mechanism includes a plurality of limbs circumferentially spaced around the protrusion. The plurality of limbs may extend outwardly from the accessory in plan view when the accessory is coupled to the backer. Each of the limbs is flexibly tensionable against an article when the backer is positioned against a first side of the article and the accessory is positioned against an opposite second side of the article, and when the protrusion is received in the cavity.

In one embodiment, the accessory is a locket. In one implementation, the locket comprises a body, a lid removably coupleable to a peripheral portion of a first side of the body, and a lens removably coupleable to the first side and intermediate the body and the cover. The lid may have a ring configuration which includes a flange receivable in a correspondingly configured groove defined by the peripheral portion of the first side. In one implementation, the body, lid and lens are concentrically disposed around the cavity within the body of the accessory. In addition, the magnet may be coupled to the body and concentrically disposed around the cavity. In one implementation, the locket includes an accessory attachment portion for coupling additional and/or auxiliary items to the body.

DETAILED DESCRIPTION OF PREFERRED EMBODIMENTS

The present invention relates to an accessory attachment system including an accessory (e.g., such as piece of jewelry, a badge, a nametag, or other such decorative item suitable for securing to a thin sheet of material, preferably an article of apparel), and a connector mechanism for securing the accessory to the material. The connector mechanism permits attachment of the accessory at various selected locations on the wearer, and may be utilized with various types of material. The accessory is securely held in the desired location and orientation on the material.

A decorative accessory and connector mechanism according to an embodiment of the present invention are illustrated in FIGS. 1-4. In one implementation, the decorative accessory is configured as a locket 100 including a body portion 101, and the connector mechanism is configured to comprise an attachment portion 111 and a backing portion 121. Each of body portion 101, attachment portion 111, and backing portion 121 may have any suitable geometry, e.g., such as but not limited to, round, circular, substantially circular, spherical, cylindrical, oval, elliptical, square, triangular, multi-lobed, varied, irregular, or other geometrical shape, or a combination thereof. Additionally, the geometry of each of body portion 101, attachment portion 111, and backing portion 121 may be the same, substantially the same, or different from the geometry of the other portions.

Figure 1:
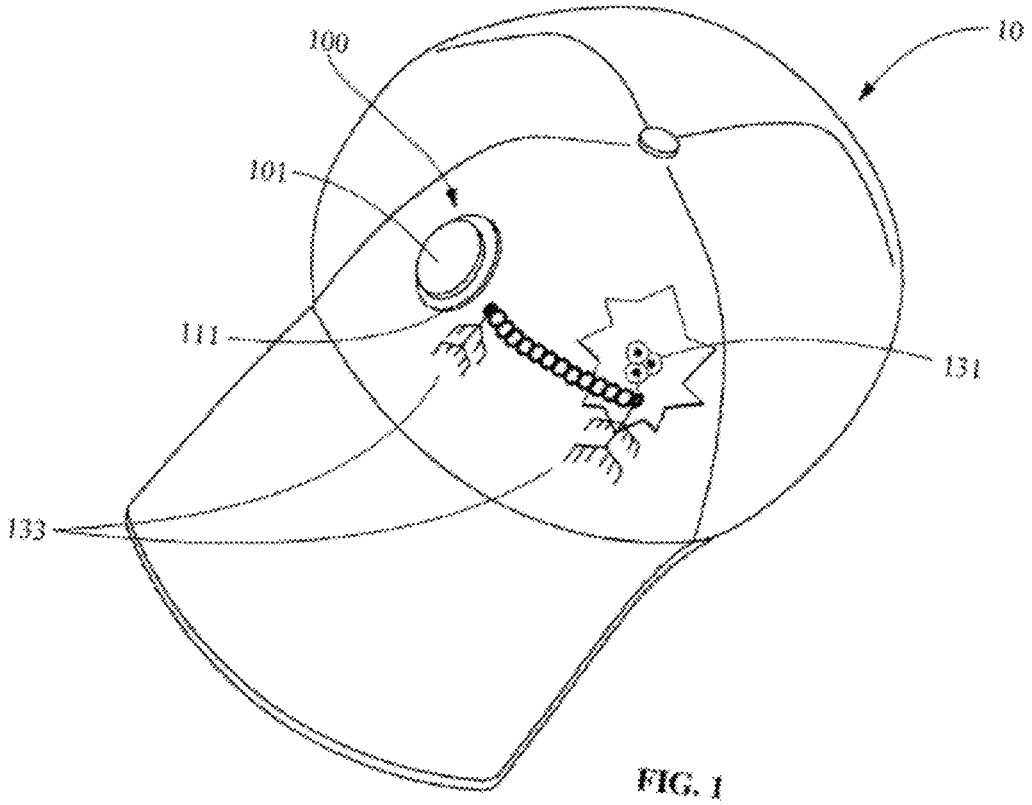
FIG. 1 is a perspective view of a locket secured to an article according to an embodiment of the present invention.

In one implementation, locket 100 includes a disc member 131 positioned distally from body portion 101, attachment portion 111, and backing portion 121, as shown in FIG. 1. Disc member 131 provides an attachment point(s) for an additional accessory and/or item(s) 133, e.g. such as a chain, a decorative member, jewelry, magnetic jewelry, digital display, or combination thereof. For example, in one embodiment, disc member 131 may be positioned adjacent to an inner surface of an article 10, such as a hat, and includes three raised portions that magnetically engage the accessory 133 positioned adjacent to an outer surface of article 10. As will be appreciated by those skilled in the art, article 10 is not limited to a hat, and may be any suitable article such as, for example, a shirt, a blouse, pants, shorts, scarf, or other sheet of fabric material or article of apparel.

Figure 2:
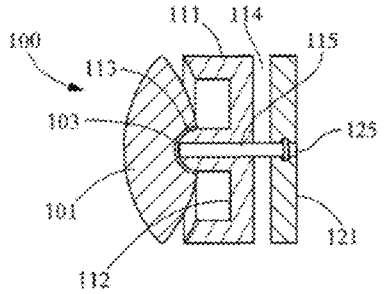
FIG. 2 is a sectional view of a locket according to a disclosed embodiment.
Figure 3:
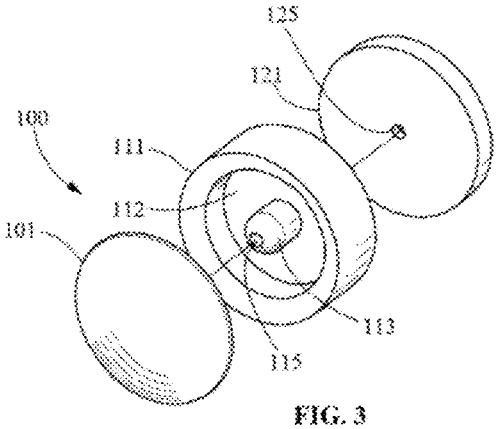
FIG. 3 is a front exploded perspective view of the locket of FIG. 2.
Figure 4:
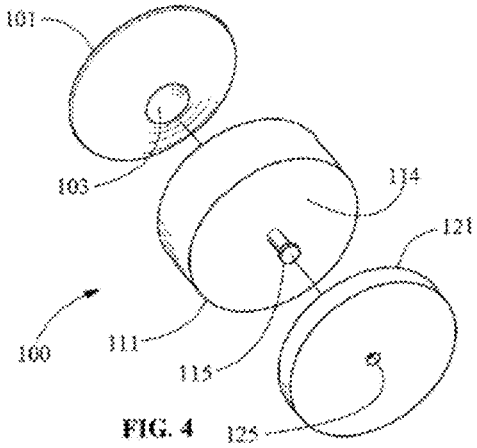
FIG. 4 is a rear exploded perspective view of the locket of FIG. 2.

Referring to FIGS. 2-4, attachment portion 111 includes an inner face 112 and an outer face 114. In one embodiment, backing portion 121 is detachably secured to attachment portion 111 adjacent outer face 114. In another embodiment, attachment portion 111 includes an elongated member 115 extending outwardly from outer face 114. Elongated member 115 includes any suitable member, such as, but not limited to, a tube, a cylinder, a grommet, a flanged member, or a combination thereof. In a further embodiment, backing portion 121 includes an aperture 125 correspondingly configured to receive and/or secure elongated member 115 therein, thereby detachably securing attachment portion 111 to backing portion 121. For example, a geometry of aperture 125 may be similar, substantially similar, or different from a geometry of elongated member 115, and include any suitable size for securing elongated member 115 therein. Aperture 125 may also include a groove, detent, slot, or other element configured to retain elongated member 115 within aperture 125.

Figure 10:
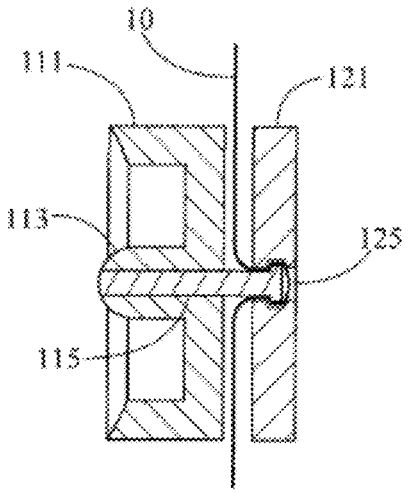
FIG. 10 is a sectional view of a locket secured to an article via a connector mechanism according to a disclosed embodiment.
Figure 11:
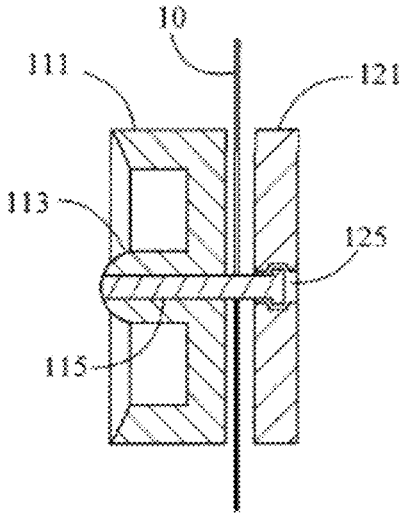
FIG. 11 is a sectional view of a locket secured to an article via a connector mechanism according to an embodiment.

Turning to FIGS. 10 and 11, in one embodiment, attachment portion 111 is positioned adjacent to and/or in contact with an outer surface of article 10, and detachably secured to backing portion 121, which is positioned adjacent to and/or in contact with an inner surface of article 10. Attachment portion 111 is detachably secured to backing portion 121 through article 10, maintaining a position of attachment portion 111 and backing portion 121 with respect to article 10. For example, in another embodiment, as illustrated in FIG. 10, elongated member 115 and a portion of article 10 are inserted within aperture 125 to detachably secure attachment portion 111 to backing portion 121 without penetrating article 10.

Referring to FIG. 11, in another embodiment, elongated member 115 passes through article 10 and is inserted into aperture 125 to detachably secure attachment portion 111 to backing portion 121. As will be appreciated by those skilled in the art, elongated member 115 may penetrate article 10, or one or more holes may be preformed in article 10, whereby each of the one or more holes permits passage of elongated member 115 therethrough.

Figure 12:
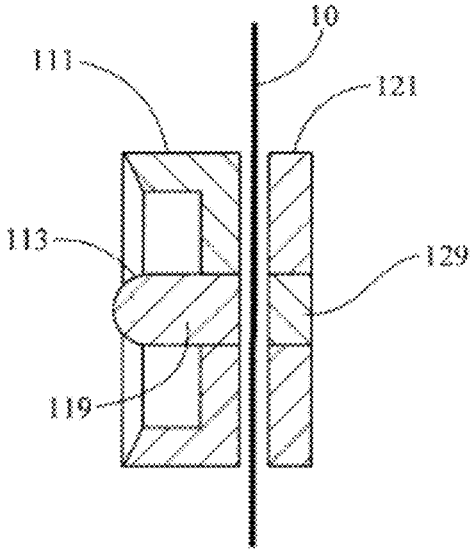
FIG. 12 is a sectional view of a locket secured to an article via a connector mechanism according to an embodiment.

As illustrated in FIG. 12, additionally or alternatively, attachment portion 111 and/or backing portion 121 may include a magnetized material 119 configured to detachably secure attachment portion 111 to backing portion 121. The magnetized material detachably secures attachment portion 111 on the outer surface of article 10 to backing portion 121 on the inner surface of article 10 without penetrating and/or deforming article 10.

Referring again to FIGS. 2-4, inner face 112 is formed substantially opposite outer face 114, and is configured to detachably secure body portion 101 thereto. For example, in one embodiment, body portion 101 includes a recessed section 103 and inner face 112 of attachment portion 111 includes a raised section 113 having a geometry corresponding to recessed section 103. When body portion 101 is positioned adjacent to inner face 112, recessed section 103 contacts raised section 113, aligning the body portion 101 with attachment portion 111, as shown in FIG. 2.

In one implementation, recessed section 103 and/or raised section 113 includes a magnetic material, such as, but not limited to, a ferromagnetic material, a ferrimagnetic material, a neodymium magnet, a samarium-cobalt magnet, any other magnetized material, or a combination thereof. The magnetic material forms a magnetic attraction between body portion 101 and attachment portion 111, such that attachment portion 111 magnetically engages body portion 101 and detachably secures body portion 101 to attachment portion 111. Additionally or alternatively, detachably securing body portion 101 to attachment portion 111 may include any other suitable method, such as, but not limited to, mechanical engagement, threaded engagement, locking engagement, clasping, mating hook and loop fasteners, or a combination thereof.

Figure 7A:
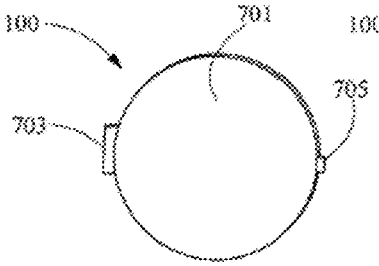
FIG. 7*a* is a front view of a locket according to a disclosed embodiment and disposed in a closed position.
Figure 7B:
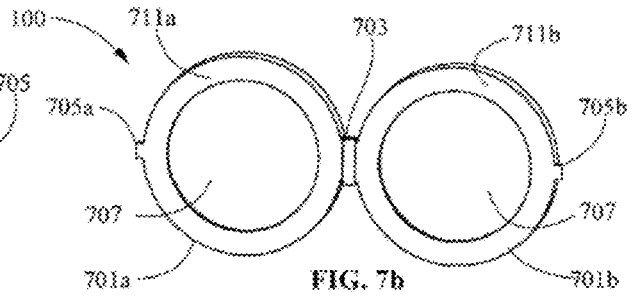
FIG. 7*b* is a front view of the locket of FIG. 7*a* and disposed in an open position.
Figure 8A:
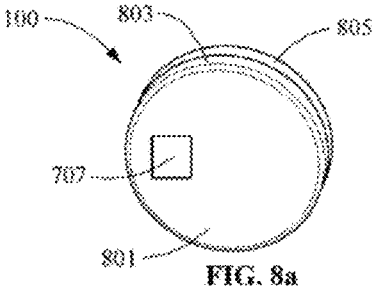
FIG. 8*a* is a front perspective view of a locket according to another embodiment and disposed in a closed position.
Figure 8B:
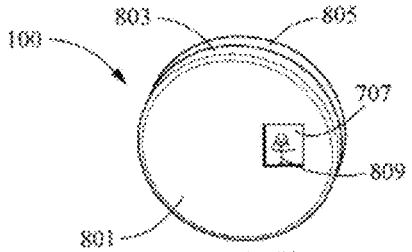
FIG. 8*b* is a front perspective view of the locket of FIG. 8*a* and disposed in an open position.
Figure 9A:
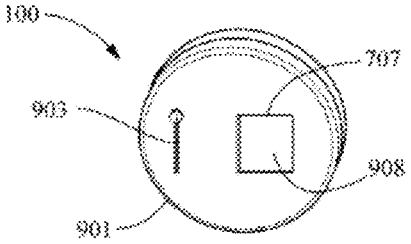
FIG. 9*a* is a front perspective view of a locket according to an embodiment and disposed in a closed position.
Figure 9B:
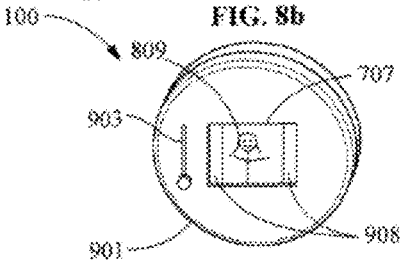
FIG. 9*b* is a front perspective view of the locket of FIG. 9*a* and disposed in an open position.

Referring to FIGS. 7-9, body portion may comprise any suitable configuration or device for receiving and/or displaying an object 809 (see FIGS. 8*b* and 9*b*) therein. For example, a suitable object 809 may include, but is not limited to, a photo or image, a jewel, a keepsake, another decorative item, or a combination thereof. Referring to FIGS. 7*a* and 7*b*, in one embodiment, body portion 101 includes a hinged body portion 701. Hinged body portion 701 includes a hinge 703 movably coupling a first member 701*a* to a second member 701*b*. The first member 701*a* and the second member 701*b* are movable between a closed position (FIG. 7*a*) and an open position (FIG. 7*b*). A clasp 705 or other locking device is formed on hinged body portion 701 to selectively maintain the first member 701*a* and the second member 701*b* in the closed position. As shown in FIG. 7*b*, an inner surface 711 of the first member 701*a* and/or the second member 701*b* includes a display area 707 formed therein. When in the closed position, display area 707 and any object 809 positioned within display area 707 is hidden from view. Alternatively, when in the open position, display area 707 and any object 809 positioned within display area 707 is visible.

Referring to FIGS. 8*a* and 8*b*, in another embodiment, body portion 101 includes a rotatable body portion 801. Rotatable body portion 801 includes a first member 803 movably coupled to a second member 805, the first member 803 being rotatable with respect to the second member 805. Display area 707 of rotatable body portion 801 is formed in the first member 803, and object 809 is positioned within the second member 805 and/or between the first member 803 and the second member 805. In the closed position, shown in FIG. 8*a*, the first member 803 is rotated with respect to the second member 805 such that object 809 is not visible through display area 707. Alternatively, as shown in FIG. 8*b*, in the open position, the first member 803 is rotated with respect to the second member 805 to align display area 707 with object 809, such that object 809 is visible through display area 707.

Referring to FIGS. 9*a* and 9*b*, in another embodiment, body portion 101 includes an actuatable body portion 901. Actuatable body portion 901 includes a cover member 908 movably positioned over display area 707. An actuating member 903 is coupled to cover member 908; actuating member 903 is configured to move cover member 908 between the closed position (FIG. 9*a*) and the open position (FIG. 9*b*). For example, in one embodiment, actuating member 903 includes a lever or sliding button that moves cover member 908 between the closed and open positions with respect to display area 707. Although illustrated as including two panels, as will be appreciated by those skilled in the art, cover member 908 is not so limited, and may alternatively include a single panel, or more than two panels. Additionally, although shown as being partially visible in the open position, as will be appreciated by those skilled in the art, cover member 908 may be completely hidden within actuatable body portion 901 when in the open position.

Figure 5:
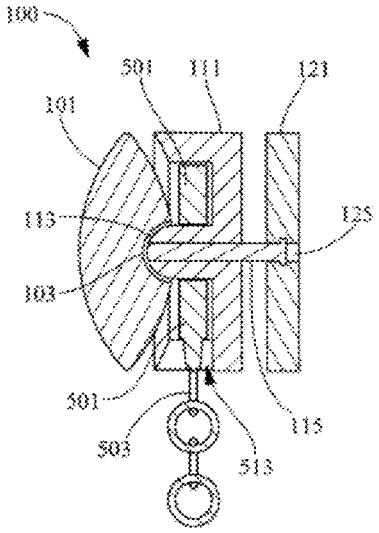
FIG. 5 is a sectional view of a locket including an intermediate portion according to a disclosed embodiment.
Figure 6:
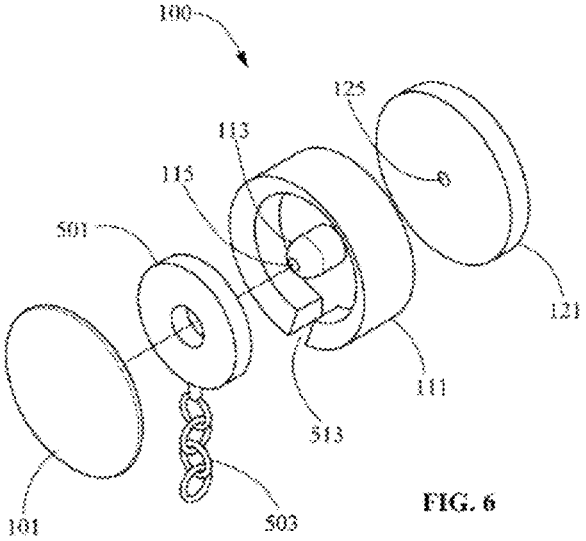
FIG. 6 is a front exploded perspective view of the locket of FIG. 5.

Referring now to FIGS. 5 and 6, in one embodiment, locket 100 includes an intermediate portion 501. Intermediate portion 501 may comprise any geometry suitable for positioning within and/or against inner face 112 of attachment portion 111. For example, in one embodiment, intermediate portion 501 is substantially circular, and includes a central opening for receiving raised section 113 therein. In another embodiment, intermediate portion 501 includes a coupling member 503 extending from a perimeter thereof. An opening 513 formed in the perimeter of attachment portion 111 corresponds to coupling member 503, permitting coupling member 503 to extend from locket 100 when intermediate portion 501 is positioned within and/or against inner face 112 of attachment portion 111. In one implementation, intermediate portion 501 is detachably secured to attachment portion 111 through any suitable method, such as, but not limited to, mechanically engaging the raised section 113, mechanically engaging the perimeter of attachment portion 111, engaging a fastener (e.g., clasp, hook and loop fastener, clip) on inner face 112, and/or being held by body portion 101 detachably secured to attachment portion 111 as described above.

Coupling member 503 may be configured, or include a suitable device, for attaching one or more accessories 133 thereto. For example, as illustrated in FIG. 6, coupling member 503 may include a chain secured to intermediate portion 501. Other suitable coupling members may be utilized, e.g., including, but are not limited to, a rope or string, a cord, a cable, or a combination thereof. In one embodiment, coupling member 503 extends from intermediate portion 501 and includes a free distal end, with one or more accessories 133 attachable thereto. In another embodiment, coupling member 503 and/or one or more of accessories 133 attached thereto is/are detachably secured to disc member 131, wherein coupling member 503 extends between intermediate portion 501 and disc member 131. Additionally or alternatively, coupling member 503 itself may include a design and/or pattern to form a decorative item with or without the one or more accessories 133.

Figure 13:
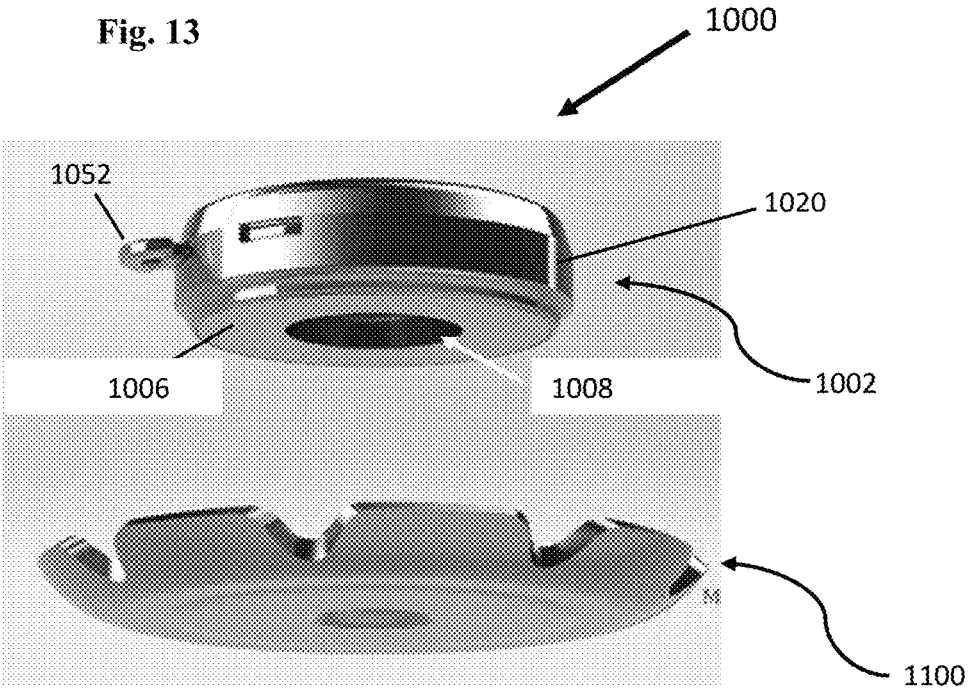
FIG. 13 is a perspective view of an accessory attachment system according to an embodiment of the present invention.

Referring now to FIGS. 13. 14 and 15, an accessory attachment system 1000 according to another embodiment is illustrated. System 1000 is configured to releasably secure a decorative accessory or other such item (e.g., jewelry, a nametag, a badge, etc.) to a sheet of material (e.g., such as an article of apparel, or sheet of fabric, cloth, etc.). In one implementation, system 1000 includes an accessory configured as a locket 1002, and a backer 1100 releasably coupleable to locket 1002.

Figure 15:
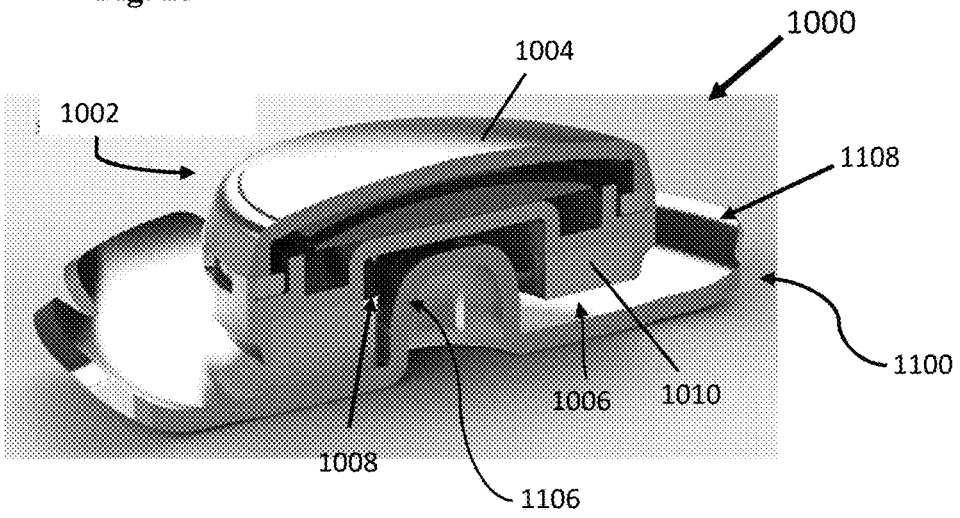
FIG. 15 is a sectional view of an accessory attachment system according to an embodiment of the present invention.
Figure 16:
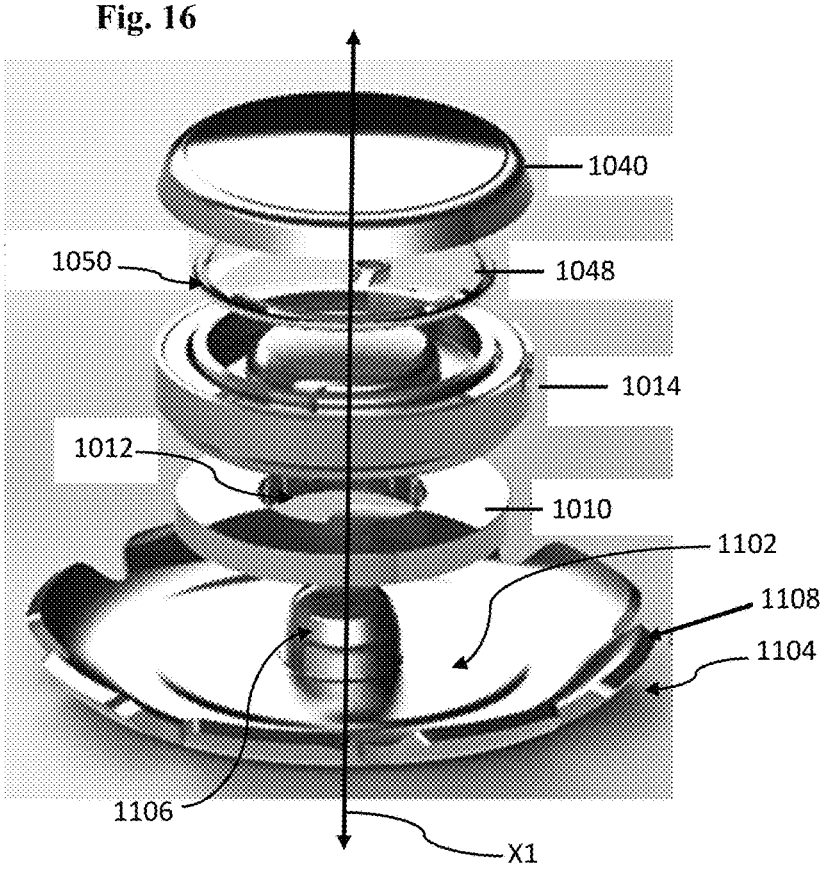
FIG. 16 is another perspective view of an accessory attachment system showing components of a locket according to an embodiment of the present invention.

Locket 1002 includes a first side 1004 and an opposite second side 1006. A recess or cavity 1008 extends into second side 1006. In one implementation, a magnet 1010 is coupled to second side 1006 adjacent to cavity 1008, as shown in FIG. 15. In one implementation, magnet 1010 has a ring configuration including a central opening 1012, as shown in FIGS. 15 and 16. Opening 1012 of magnet 1010 may partially define cavity 1008 in second side 1006 (see FIG. 15). In another implementation, a magnet including one or more portions comprising a magnetic material is disposed around or adjacent cavity 1008. For example, 2, 3, 4 or more portions including magnetic material may be provided, which are circumferentially or otherwise spaced around cavity 1008.

Figure 17:
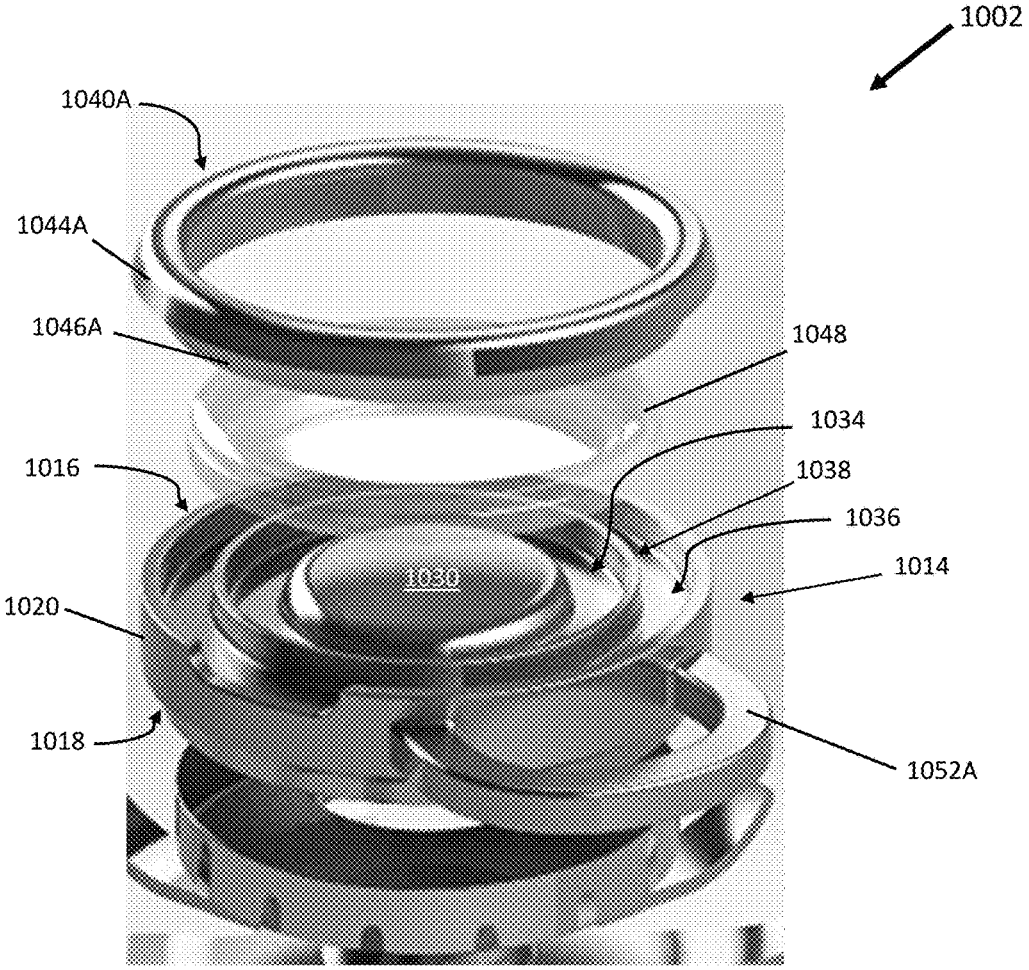
FIG. 17 is another perspective view of components of a locket according to an embodiment of the present invention.
Figure 18:
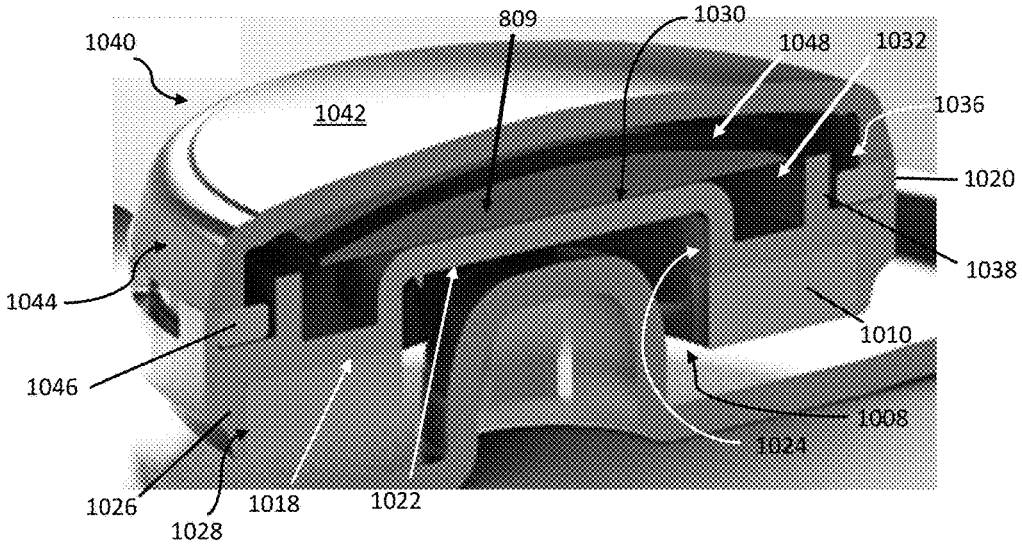
FIG. 18 is another sectional view of portions of an accessory attachment system according to an embodiment of the present invention.

Referring to FIGS. 17 and 18, in one embodiment locket 1002 includes a body portion 1014 having a front face 1016 and an opposite rear surface 1018, and a side surface 1020 intermediate and extending between front face 1016 and rear surface 1018. In one implementation, body portion 1014 has a generally cylindrical configuration in plan view, with a circular or curved side surface 1020. Cavity 1008 extends into rear surface 1018 of body portion 1014, and includes a base 1022 and a wall portion 1024 (FIG. 18). In one implementation, magnet 1010 is connected to rear surface 1018 and partially defines wall portion 1024 of cavity 1008. Side surface 1020 may include or define a lip 1026 against which an outer wall 1028 of magnet 1010 is disposed. Preferably, lip 1026 substantially or completely conceals outer wall 1028 of magnet 1010.

With continued reference to FIGS. 17 and 18, base 1022 partially defines a floor 1030 of a recess or compartment 1032 in body portion 1014. A groove or first channel 1034 is adjacent to and extends around floor 1030, and another groove or second channel 1036 is adjacent to and extends around first channel 1034 (FIG. 17). First and second channels 1034, 1036 are separated or defined by an inner wall 1038. Thus, first channel 1034 is disposed between floor 1030 and inner wall 1038, and second channel 1036 is disposed between inner wall 1038 and side surface 1020.

Referring to FIGS. 16 and 18, in one embodiment, locket 1002 includes a cover or lid 1040, which is removably coupleable to body portion 1014. Lid 1040 includes an exteriorly disposed front surface 1042 and side portion 1044. Side portion 1044 defines or includes a flange 1046 configured to be received in second channel 1036 (FIG. 18). In one implementation, flange 1046 may be securely seated within second channel 1036, and/or against a surface of side surface 1020 and/or inner wall 1038, so that lid 1040 is removably secured to body portion 1014 via friction fit. Alternatively or in addition, lid 1040 may be formed from a metal and/or comprise a magnetically coupleable material (e.g., metal), so that lid 1040 is magnetically coupled to body portion 1014 via magnet 1010 when lid 1040 is properly positioned against front face 1016 of body portion 1014. Thus, lid 1040 is separable and discrete from body portion 1014, but may be securely retained on body portion 1014.

As shown in FIGS. 16 and 18, in one embodiment front surface 1042 of lid 1040 covers compartment 1032 when lid 1040 is secured to body portion 1014. However, in alternative embodiments, a lid 1040A may be provided which has a generally ring-shaped configuration, comprising an open front and/or other openings and defined primarily by a side portion 1044A, as shown in FIG. 17. Side portion 1044A includes a flange 1046A, which is received in second channel 1036 as described above.

In one embodiment, locket 1002 additionally includes a lens 1048 removably retained on body portion 1014, and/or between body portion 1014 and lid 1040. In one implementation, lens 1048 is transparent. An object 809 (e.g., such as a photo or other keepsake as described above) may be placed within compartment 1032 and retained therein and viewable through lens 1048. In one implementation, lens 1048 includes a peripheral rim 1050 (see FIG. 16) configured to engage or rest on inner wall 1038, and/or be received in first or second channel 1034, 1036, so that lens 1048 does not slide or otherwise move relative to body portion 1014 when disposed thereon.

As shown in FIGS. 17 and 18, floor 1030 of compartment 1032 provides a planar surface on which an object 809 (e.g., such as a photo or other keepsake) may be placed. In addition, floor 1030 is raised relative to the surrounding first channel 1034. The configuration of floor 1030 and compartment 1032 ensures that object 809, and in particular a flexible sheet of material such as a photo, retains its form and correct orientation within compartment 1032. The possibility that a photo retained within compartment 1032 will crease, bend or sag is thereby minimized given the photo is supported by floor 1030.

Referring again to FIGS. 15 and 16, in one embodiment body portion 1014 has a circular configuration in plan view, which is concentrically aligned with cavity 1008 about center axis X1. In one implementation, lid 1040 and/or lens 1048 are additionally concentrically aligned about axis X1. In one implementation, magnet 1010 may have a ring configuration and/or also be concentrically aligned about axis X1 (FIG. 16).

Referring again to FIGS. 13 and 14, in one embodiment locket 1002 includes an accessory attachment portion 1052 coupled to side surface 1020 of body portion 1014. In one implementation, attachment portion 1052 is connected to and extends outwardly from side surface 1020, and includes an opening through which a secondary accessory (e.g., such as a chain, hoop, etc.) may be secured, as known in the art. In another embodiment, lid 1040 may alternatively or additionally include an accessory attachment portion configured for securing secondary or additional decorative accessories thereon. It should be understood that attachment portion 1052 is not limited to the exemplary configuration shown in FIGS. 13 and 14. For example, an attachment portion 1052A having a generally D-shaped configuration extending outwardly from and connected to side surface 1020 may be provided, such as shown in FIG. 17.

Referring to FIGS. 15 and 16, backer 1100 includes a central portion 1102 and a peripheral portion 1104. A protrusion 1106 extends outwardly from central portion 1102 and is receivable in cavity 1008 (FIG. 15). Thus, opening 1012 of magnet 1010 and/or cavity 1008 encircles protrusion 1106 when protrusion 1106 is disposed within cavity 1008. A sidewall portion 1108 extends outwardly from peripheral portion 1104. Magnet 1010 is adjacent to protrusion 1106 and central portion 1102 of backer 1100 when protrusion 1106 is received in cavity 1008.

Backer 1100 comprises a portion comprising metal or another material that is magnetically attracted and coupled to magnet 1010 when protrusion 1106 is received in cavity 1008. Thus, backer 1100 is aligned with locket 1002 when protrusion 1106 is aligned and received within cavity 1008, thereby ensuring that backer 1100 is properly coupled to locket 1002.

Figure 19:
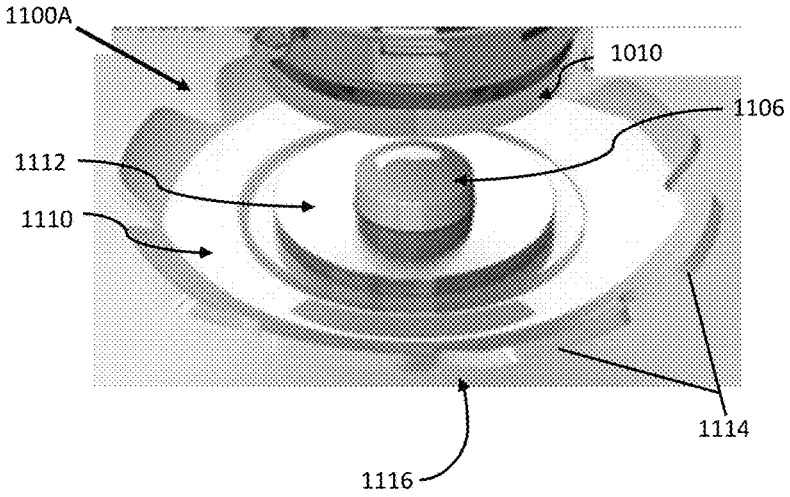
FIG. 19 is a perspective view of portions of an accessory attachment system of the present invention and showing a backer according to an embodiment of the present invention.

In one implementation, backer 1100 is formed from a magnetic material (e.g. metal). In another implementation, a backer 1100A is provided including a first portion 1110 formed from a nonmagnetic material (e.g., a polymer material) and a second portion 1112 formed from a magnetic or magnetically coupleable material, which may be aligned with magnet 1010, as shown in FIG. 19. Second portion 1112 of backer 1100 may be configured as a metal ring or washer disposed on a plastic or nonmagnetic first portion 1110, wherein the metal second portion 1112 is adjacent to and encircles protrusion 1106. Second portion 1112 is magnetically coupleable to magnet 1010 on locket 1002 when protrusion 1106 is aligned with and received in cavity 1008, as described above.

In addition or alternatively, second portion 1112 of backer 1100 may be a second magnet and/or comprise a magnetic portion(s) or material. Thus, in one implementation, magnet 1010 on locket 1002 is a first magnet, and second portion 1112 may comprise or be configured as a second magnet. The first magnet (e.g., magnet 1010) of locket 1002 is coupleable to the second magnet (e.g., second portion 1112) when locket 1002 is aligned with backer 1100A. Providing for first and second magnets enhances coupling and attraction between locket 1002 and backer 1100A, which may be desirable for some applications (e.g., such as when attaching system 1000 to relatively thick material).

Figure 20:
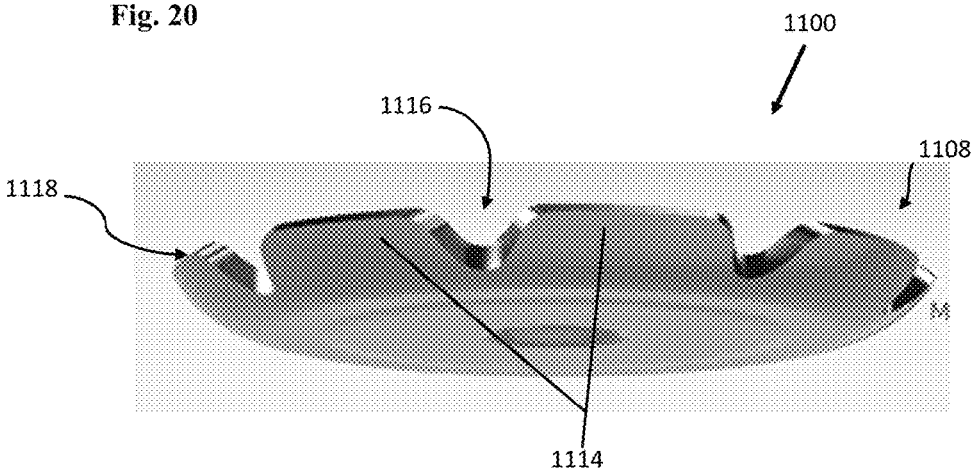
FIG. 20 is a bottom perspective view of a backer according to an embodiment of the present invention.

Referring to FIGS. 19 and 20, sidewall portion 1108 of backer 1100 (or backer 1100A) may comprise a plurality of extensions or limbs 1114 circumferentially spaced around protrusion 1106. In one implementation, each of limbs 1114 has a generally petal-shaped or rounded configuration, and are spaced from each other via gaps 1116 in sidewall portion 1108. However, the specific configuration of backer 1100 and/or limbs 1114 is not so limited.

Figure 21:
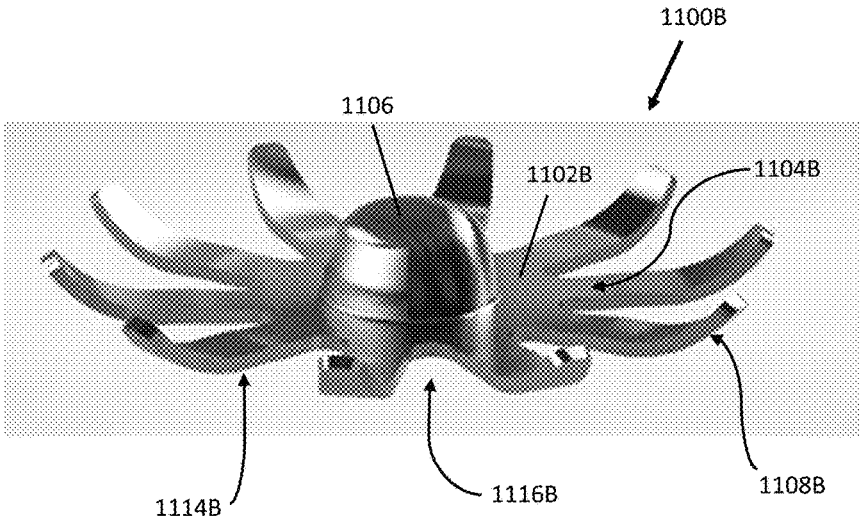
FIG. 21 is a top perspective view of a backer according to an embodiment of the present invention.

In another embodiment, a backer 1100B suitable for use with locket 1002 and/or another accessory as part of the disclosed accessory attachment system includes a plurality of limbs 1114B having an alternative configuration, as shown in FIG. 21. Limbs 1114B are narrower as compared to limbs 1114, with gaps 1116B that are wider and extend further into a central portion 1102B thereof as compared to limbs 1114. Thus, a central portion 1102B of backer 1100B has a smaller footprint or surface area in plan view as compared to central portion 1102. An outer portion of limbs 1114B define a sidewall portion 1108B, extending outwardly and angularly relative to a portion 1104B adjacent to central portion 1102B. Limbs 1114B are circumferentially spaced around protrusion 1106, which extends upwardly from central portion 1102B and is receivable in cavity 1008 as described above.

Figure 22:
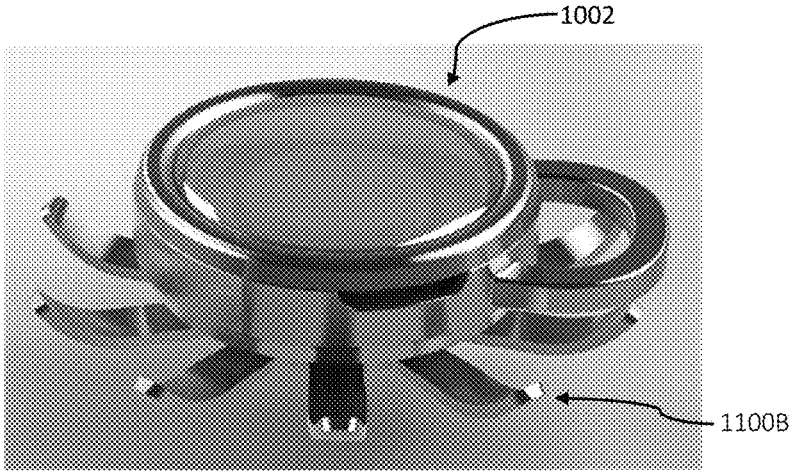
FIG. 22 is a perspective view of an accessory attachment system according to an embodiment of the present invention.
Figure 23:
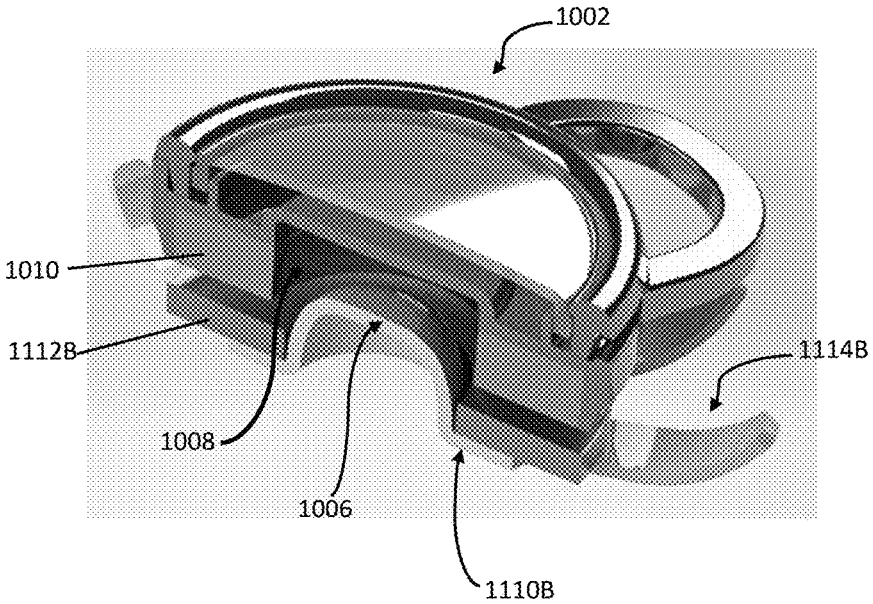
FIG. 23 is another sectional view of portions of an accessory attachment system according to an embodiment of the present invention.

In one implementation, backer 1100B is formed from a magnetic or magnetically coupleable material, which is magnetically coupleable to locket 1002 (or other accessory), as shown in FIG. 22. In another implementation, backer 1100B comprising a first portion 1110B formed from a nonmagnetic material (e.g., a plastic) and/or comprises a component or second portion 1112B formed from or comprising a magnetic material, which is magnetically attracted and coupled to magnet 1010 of locket 1002 when protrusion 1106 is received in cavity 1008, as shown in FIG. 23. Second portion 1112B may be configured as a metal ring or washer disposed on a plastic or nonmagnetic first portion 1110B, wherein the metal second portion 1112B is adjacent to and encircles protrusion 1106. Second portion 1112B is magnetically coupleable to magnet 1010 on locket 1002 when protrusion 1106 is aligned with and received in cavity 1008, as described above.

Figure 24:
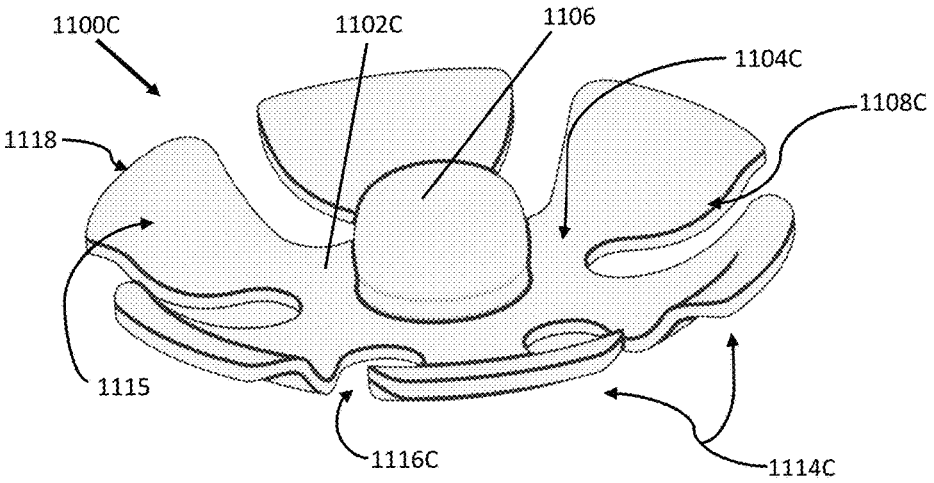
FIG. 24 is a top perspective view of a backer according to an embodiment of the present invention.

In another embodiment, a backer 1100C suitable for use with locket 1002 and/or another accessory as part of the disclosed accessory attachment system includes a plurality of limbs 1114C having an alternative configuration, as shown in FIG. 24. Limbs 1114C have a generally petal-shaped configuration, including a cupped or bowl-shaped inner portion 1115 and rounded or curved distal ends 1118C. Limbs 1114C are separated by gaps 1116C, which may have a slightly teardrop-shaped configuration, and extend into a central portion 1102C of backer 1100C. Thus, the limbs 1114C are wider proximate their distal ends thereof, and narrow near the attachment point to central portion 1102C. The teardrop-shaped configuration, width or size of gaps 1116C ensure that limbs 1114C are flexibly connected and disposed relative to central portion 1102C. In addition, the configuration of gaps 1116C minimize the size of central portion 1102C, thereby reducing the overall weight of backer 1100C.

The rounded distal ends 1118C of limbs 1114C prevent or minimize the possibility of agitating, snagging or otherwise damaging the fabric or material to which backer 1100C is secured. In addition, the petal-shaped configuration of limbs 1114C proactively cradles the locket 1002 (or other accessory) to which backer 1100C is securable, and prevents or minimizes the possibility of locket 1002 (or other accessory) from sliding, spinning, tilting, pulling or otherwise becoming unbalanced.

Similar to backer 1100B, central portion 1102C of backer 1100C has a smaller footprint or surface area in plan view as compared to central portion 1102 of backer 1100. However, backer 1100C preferably has a larger footprint or surface area in plan view as compared to locket 1002 (or other accessory). An outer portion of limbs 1114C define a sidewall portion 1108C, extending outwardly and angularly relative to a portion 1104C adjacent to central portion 1102C. Limbs 1114C are circumferentially spaced around protrusion 1106, which extends upwardly from central portion 1102C and is receivable in cavity 1008 as described above.

Figure 25:
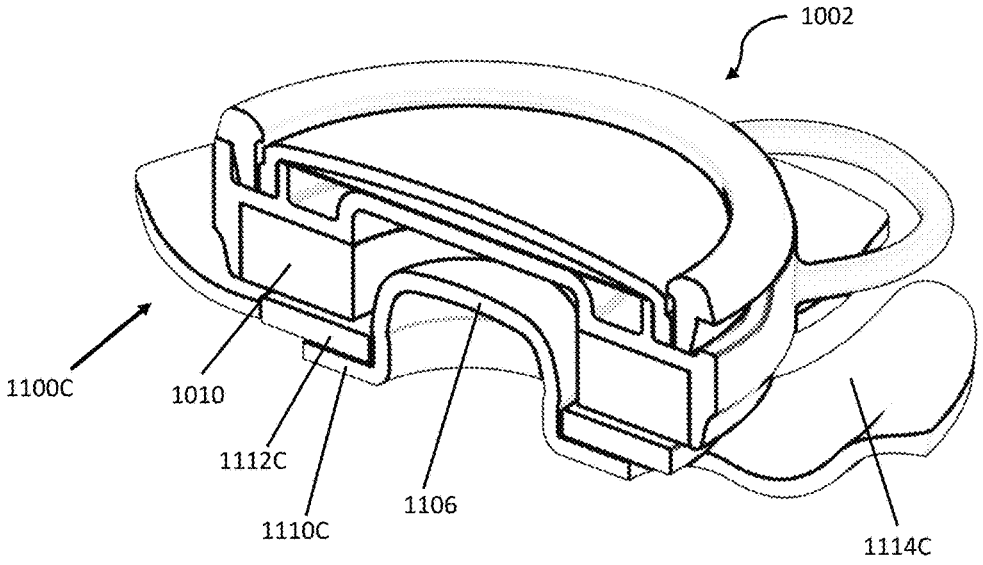
FIG. 25 is a sectional view of an accessory attachment system according to an embodiment of the present invention.

In a preferred implementation, backer 1100C comprising a first portion 1110C formed from a nonmagnetic material (e.g., a plastic) and/or comprises a component or second portion 1112C formed from or comprising a magnetic material, which is magnetically attracted and coupled to magnet 1010 of locket 1002 when protrusion 1106 is received in cavity 1008, as shown in FIG. 25. Second portion 1112C may be configured as a metal ring or washer disposed on a plastic or nonmagnetic first portion 1110C, wherein the metal second portion 1112C is adjacent to and encircles protrusion 1106. Second portion 1112C is magnetically coupleable to magnet 1010 on locket 1002 when protrusion 1106 is aligned with and received in cavity 1008, as described above. In a preferred embodiment, second portion 1112C is or includes a second magnet, which is magnetically attracted to the first magnet 1010 of locket 1002.

Providing for first and second magnets enhances the magnetic attraction between backer 1100C (or 1100 or 1100A or 1100B) and locket 1002 (or other accessory), which may be desirable when attaching system 1000 to thicker, courser fabrics or materials (e.g., such as felt or denim). Alternatively, providing for a metal or magnetically attractable second portion 1112C with a weaker magnetic attraction to locket 1002 (or other accessory), as compared to the attraction between two strong magnets, may be desirable when attaching system 1000 to finer or less dense fabrics or materials. In one implementation, two alternative second portions 1112C are provided, a first between a magnet and a second being a metal washer, which are removable from first portion 1110C. The user may then select which second portion 1112C is appropriate, depending on the particular type of fabric or material to which the system 1000 will be secured.

The rounded distal end of protrusion 1106, as well as its height and size relative to backer 1100C (or 1100 or 1100A or 1100B), prevents or minimizes the possibility of excessive pressure points or pinching of the fabric or material when backer 1100C (or 1100 or 1100A or 1100B) secured locket 1002 (or other accessory) with the fabric or material therebetween. Thus, the possibility of any pressure point markings or other damage to the fabric or material is minimized or eliminated.

Figure 26:
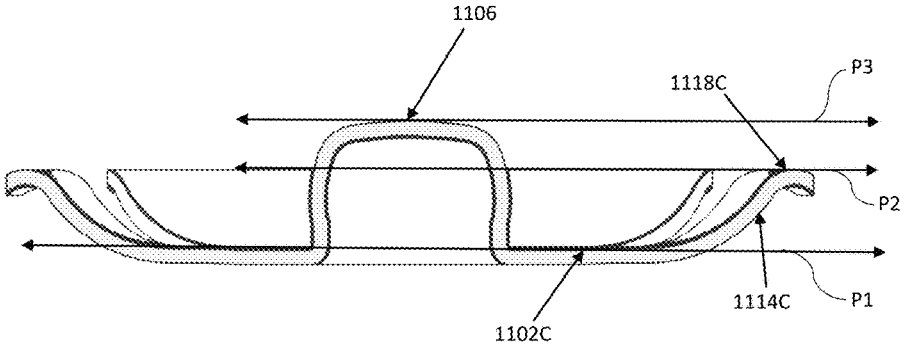
FIG. 26 is a sectional view of a backer according to an embodiment of the present invention.
Figure 27A:
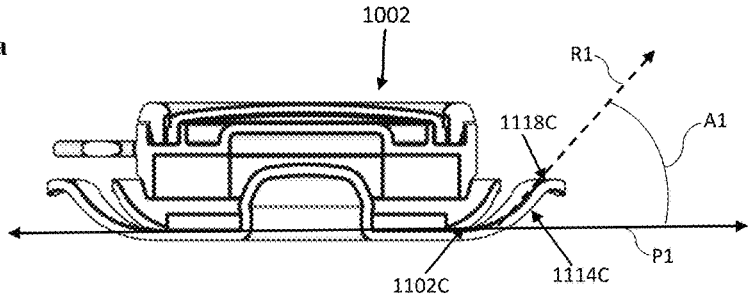
FIG. 27*a* is another sectional view of an accessory attachment system according to an embodiment of the present invention, and showing the backer and locket coupled together.

Referring to FIGS. 26 and 27*a*, central portion 1102C (or 1102 or 1102B) lies generally on a first plane P1, with limbs 1114C (or 1114 or 1114B) extending angularly and upwardly from central portion 1102C (or 1102 or 1102B) and first plane P1, and generally along a ray R1, defining an angle A1 therebetween (FIG. 27A), so that distal ends 1118C of limbs 1114C (or 1114 or 1114B) lie on a second plane P2 spaced from and parallel to first plane P1 (FIG. 26). Angle A1 is preferably between about 30° and about 80°, more preferably between about 40° and about 60° (e.g., about 50°).

Figure 27B:
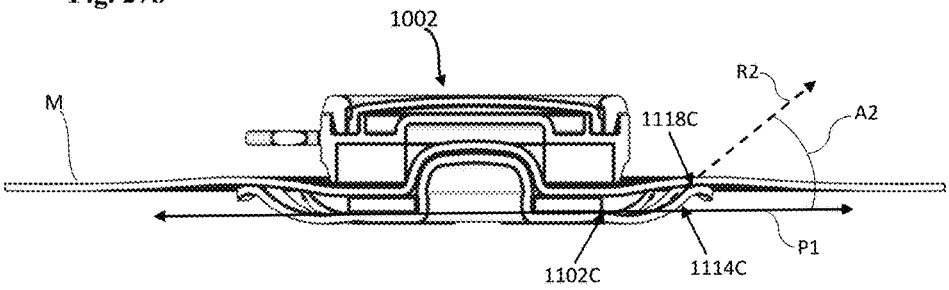
FIG. 27*b* is a sectional view of the accessory attachment system shown in FIG. 27A, and showing the backer and locket coupled together with fabric therebetween.

Referring to FIGS. 26 and 27*b*, distal ends 1118C of limbs 1114C (or 1114 or 1114B) are flexibly tensionable away from second plane P2 and toward first plane P1, such as when distal ends 1118 are pressed against or pulled downwardly by a sheet of material M. When limbs 1114C are flexibly tensioned away from second plane P2 and toward first plane P1, limbs 1114C (or 1114 or 1114B) extend angularly and upwardly from central portion 1102C (or 1102 or 1102B) and first plane P1, and generally along a ray R2, defining an angle A2 therebetween (FIG. 27*b*), wherein angle A2 is less than angle A1. Angle A2 is preferably between about 10° and about 60°, more preferably between about 20° and about 50° (e.g., about 40°). The specific values of angles A1 and A2 may vary, though angle A1 is preferably greater than angle A2.

For example, in operation backer 1100C (or 1100 or 1100A or 1100B) may be placed against an inner surface of a portion of material M, and locket 1002 is placed against an opposite outer surface of the material M. Protrusion 1106 of backer 1100C (or 1100 or 1100A or 1100B) is aligned with and received in cavity 1008 of accessory 1002. Backer 1100C (or 1100 or 1100A or 1100B) is thereby magnetically coupled to locket 1002 via magnet 1010 (or first and second magnets, and/or magnetic portions or material, as described above), with the sheet of material M disposed therebetween. The magnetic coupling between backer 1100C (or 1100 or 1100A or 1100B) and locket 1002 pulls protrusion 1106 into cavity 1008, so that distal ends 1118C of limbs 1114C (or 1114 or 1114B) are pressed against the inner surface of the material M, thereby tensionably deforming limbs 1114C (or 1114 or 1114B) so that distal ends 1118C are moved away from second plane P2 and toward first plane P1. As a result, distal ends 1118C of limbs 1114C (or 1114 or 1114B) are tensionably secured against the inner surface of the material M in a fixed position, thus minimizing the possibility of backer 1100C (or 1100 or 1100A or 1100B) sliding away from the selected position on the sheet of material M and/or spinning. Thus, the material M is sandwiched between backer 1100C and locket 1002, with the selected position and orientation of locket 1002 securely maintained thereon via the tensionably deformed limbs 1114C against material M.

The specific configuration of protrusion 1106 may vary, and depends in part on the specific configuration of cavity 1008. In addition, the specific configuration and length of limbs 1114C (or 1114 or 1114B) may vary, and depends in part on the configurations of protrusion 1106 and cavity 1008. Preferably, the height L1 of protrusion 1106 is slightly less than the depth L2 of cavity 1008, so that the magnetic coupling between backer 1100C (or 1100 or 1100A or 1100B) and locket 1002 (and/or magnet 1010) exerts a force pulling protrusion 1106 inwardly into cavity 1008. Protrusion 1106 is pulled into cavity 1008 until the sheet of material is securely sandwiched between and contacting magnet 1010 and backer 1100C (or 1100 or 1100A or 1100B), so that further movement of protrusion 1106 relative to cavity 1008 is mechanically blocked. However, a sufficient amount of movement between protrusion 1106 and cavity 1008 is permitted prior to such mechanical blockage so that distal ends 1118C of limbs 1114C are tensionably deformed against and by the sheet of material.

Figure 28:
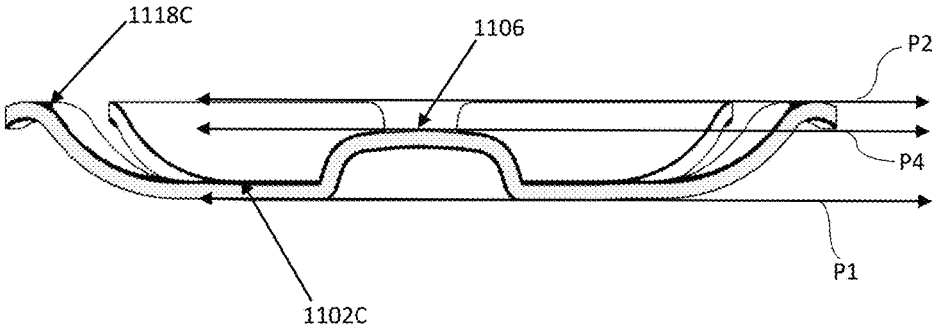
FIG. 28 is another sectional view of an accessory attachment system according to an embodiment of the present invention.
Figure 29:
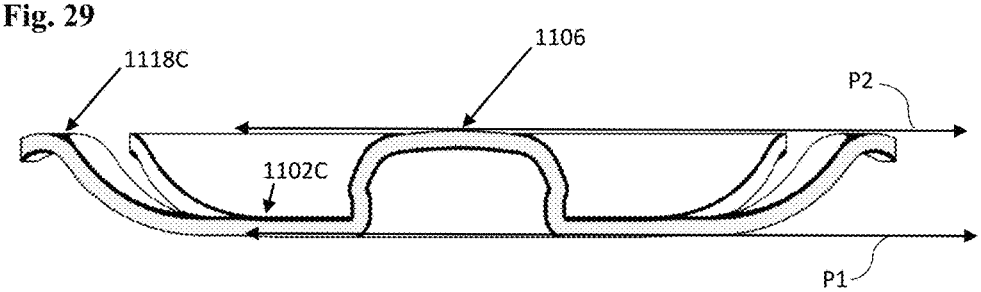
FIG. 29 is another sectional view of an accessory attachment system according to an embodiment of the present invention.

Thus, the optimal height L1 of protrusion 1106 depends in part on the length of limbs 1114C (or 1114 or 1114B) as well as the depth L2 of cavity 1008. In one implementation, protrusion 1106 extends outwardly from plane P1 and beyond the second plane P2 to a plane P3, as shown in FIG. 26. In another implementation, protrusion 1106 extends outwardly from plane P1 to a plane P4 intermediate the first plane P1 and the second plane P2, as shown in FIG. 28. In another implementation, protrusion 1106 extends outwardly from plane P1 to the second plane P2, as shown in FIG. 29.

Figure 14:
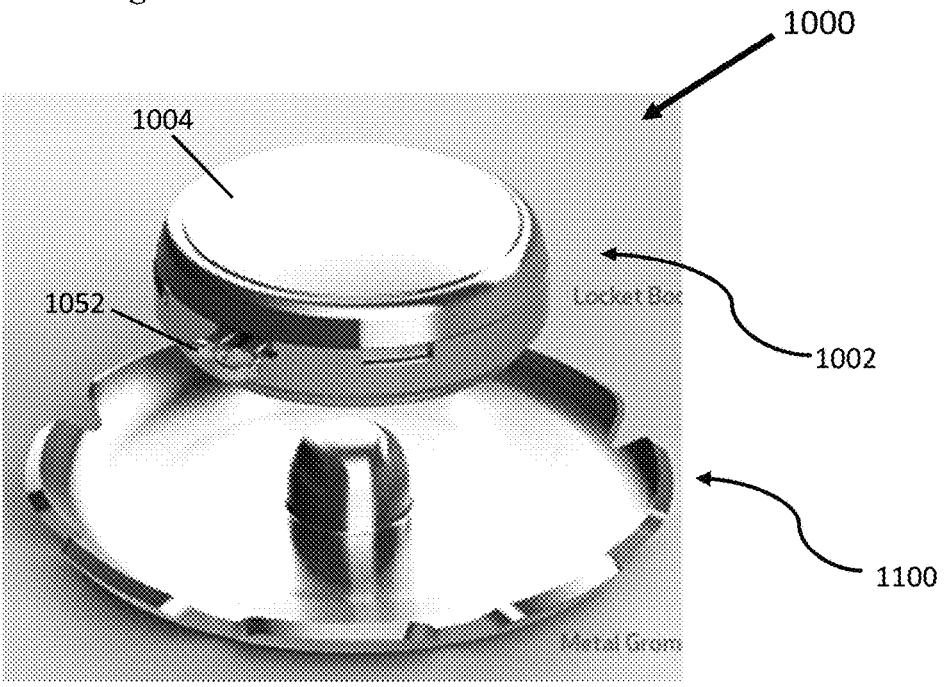
FIG. 14 is another perspective view of an accessory attachment system according to an embodiment of the present invention.

As shown in FIGS. 14 and 19, backer 1100 and backer 1100A include eight limbs 1114 circumferentially spaced around protrusion 1106. As shown in FIG. 21, backer 1100B includes ten limbs 1214 circumferentially spaced around protrusion 1106. As shown in FIG. 24, backer 1100C includes six petal-shaped limbs 1114C circumferentially spaced around protrusion 1106. However, it should be understood that backers 1100, 1100A, 1100B and/or 1100C may include fewer or more limbs. In addition, the limbs may be equally spaced about protrusion 1106 (as illustrated) or alternatively the gaps or spacing between adjacent limbs may vary. Thus, the specific number and configuration of limbs illustrated herein are exemplary and the present invention is not so limited.

However, the limbs are preferably configured to be flexibly tensionable away from the second plane P2 on which the distal ends of the limbs lie, and toward the first plane P1 on which the corresponding central portion lies, as described above. In addition, the footprint (in plan view) of the limbs is preferably greater than the footprint of locket 1002 or other accessory to which the backer is coupled, so that the limbs of the backer have a diameter greater than the diameter of locket 1002 or other accessory. In this way, the locket or other accessory is securely held in the desired position and orientation on the wearer.

While the invention has been described in connection with exemplary embodiments thereof, it will be understood that it is capable of further modifications and this application is intended to cover any variations, uses, or adaptations of the invention following, in general, the principles of the invention and including such departures from the present disclosure as come within known or customary practice within the art to which the invention pertains and as may be applied to the features hereinbefore set forth.

What is claimed is:

1. A connector mechanism for releasably securing a locket to an article of apparel comprising:

a locket comprising a body comprising a first side and an opposite second side, a cavity extending into said second side, and a lid removably coupleable to a peripheral portion of said first side;

a backer comprising a central portion and a peripheral portion, a protrusion extending outwardly from said central portion and receivable in said cavity, and a sidewall portion extending outwardly from said peripheral portion, said sidewall portion comprising a plurality of spaced limbs disposed around said protrusion; and a magnet coupled to one of said locket or said backer, said magnet adjacent said protrusion when said protrusion is received in said cavity, said locket magnetically coupleable to said backer via said magnet.

2. The mechanism of claim 1, wherein said magnet encircles said protrusion when said protrusion is received in said cavity.

3. The mechanism of claim 1, wherein said magnet is coupled to said locket and disposed adjacent said cavity.

4. The mechanism of claim 3, wherein said magnet is a first magnet, further comprising a second magnet coupled to said backer and coupleable to said first magnet when said protrusion is received in said cavity.

5. The mechanism of claim 3, wherein said backer comprises a metallic portion coupleable to said magnet when said protrusion is received in said cavity.

6. The mechanism of claim 1, wherein said magnet is coupled to said backer adjacent said protrusion.

7. The mechanism of claim 6, wherein said magnet is a first magnet, further comprising a second magnet coupled to said locket and coupleable to said first magnet when said protrusion is received in said cavity.

8. The mechanism of claim 1, wherein said plurality of limbs are circumferentially spaced around said protrusion, each one of said plurality of limbs having a generally petal-shaped configuration.

9. The mechanism of claim 1, wherein said plurality of limbs extend outwardly from said locket in plan view when said locket is coupled to said backer.

10. The mechanism of claim 1, wherein each one of said plurality of limbs is flexibly tensionable against an article when said backer is positioned against a first side of said article and said locket is positioned against an opposite second side of said article, and when said protrusion is received in said cavity.

11. The mechanism of claim 1, wherein said central portion lies on a first plane, and said sidewall extends outwardly from said first plane to a second plane, and wherein said protrusion extends outwardly from said first plane to a third plane.

12. The mechanism of claim 11, wherein said third plane is intermediate said first and second planes.

13. The mechanism of claim 11, wherein said third plane is coplanar with said second plane.

14. The mechanism of claim 1, further comprising:

a lens removably coupleable to said first side of said body.

15. The mechanism of claim 14, wherein said body, said lid and said lens are concentrically disposed around said cavity.

16. The mechanism of claim 15, wherein said magnet is coupled to said body and concentrically disposed around said cavity.

17. The mechanism of claim 1, wherein said lid has a ring configuration including a flange receivable in a correspondingly configured groove defined by said peripheral portion of said first side.

18. The mechanism of claim 1, wherein said magnet has a ring configuration concentrically aligned with said lid.

19. The mechanism of claim 1, further comprising an accessory attachment portion coupled to said body.

* * * * *